US006726393B2

(12) United States Patent
Tsai et al.

(10) Patent No.: US 6,726,393 B2
(45) Date of Patent: Apr. 27, 2004

(54) CONNECTING DEVICE FOR CONNECTING A TOOL WITH TOOL BITS OF DIFFERENT LENGTHS

(76) Inventors: Sheng-Chung Tsai, No. 1-8, Lane 11, Hao Lai 3rd Street, Ta Li City, Taichung Hsien (TW); Hsin-Ming Chiang, 3F, No. 86, Lane 175, Tung Ming Road, Ta Li City, Taichung Hsien (TW)

( * ) Notice: Subject to any disclaimer, the term of this patent is extended or adjusted under 35 U.S.C. 154(b) by 0 days.

(21) Appl. No.: 10/227,291

(22) Filed: Aug. 26, 2002

(65) Prior Publication Data

US 2004/0037617 A1 Feb. 26, 2004

(51) Int. Cl.[7] ..... B25B 23/16

(52) U.S. Cl. ..... 403/109.4; 403/109.6; 403/322.2; 16/110.1

(58) Field of Search ..... 16/110.1, 422; 403/109.1, 109.4, 109.6, 109.2, 322.2, 325

(56) References Cited

U.S. PATENT DOCUMENTS

| | | | | | |
|---|---|---|---|---|---|
| 3,260,541 | A | * | 7/1966 | Sadler et al. | 403/325 |
| 4,376,397 | A | * | 3/1983 | Newby et al. | 81/177.2 |
| 5,934,384 | A | * | 8/1999 | Wang | 81/177.85 X |
| 2003/0140744 | A1 | * | 7/2003 | Chen | 81/438 |
| 2003/0145693 | A1 | * | 8/2003 | Huang | 81/438 |

* cited by examiner

*Primary Examiner*—John R. Cottingham
(74) *Attorney, Agent, or Firm*—Rosenberg, Klein & Lee

(57) ABSTRACT

A connecting device for connecting a tool with tool bits of different lengths is taught here. The connecting device includes a shank, a socket and a position retainer. The shank includes a first end for engagement with the tool and a second end. The socket includes a first end for receiving the second end of the shank and a second end for receiving the tool bits. The position retainer is capable of selectively retaining the socket in one of various positions on the shank.

13 Claims, 8 Drawing Sheets

CONNECTING DEVICE FOR CONNECTING A TOOL WITH TOOL BITS OF DIFFERENT LENGTHS

BACKGROUND OF INVENTION

1. Field of Invention

The present invention relates to a telescopic connecting device for connecting a tool with tool bits of different lengths.

2. Related Prior Art

Taiwan Patent Publication No. 478443 discloses a connecting device for connecting a tool with a tool bit. The connecting device includes a rod 20 consisting of a shank 22 for engagement with the tool and a socket 21 for engagement with the tool bit. A slot 23 is defined through the socket 21 for receiving a latch 70. Two rings 50 and 60 are respectively received in two grooves 24 and 25 defined in an external face of the socket 21. A spring 40 is mounted on the socket 21 against the ring 50. A collar 30 includes a first end, a second end and an internal face. A first shoulder is formed on the internal face of the collar 30 at the first end. A second shoulder is formed on the internal face of the collar 30. A groove 31 is defined in the internal face of the collar 30 near the second end. When moved past the rings 50 and 60, the first end of the collar 30 pushes them into the grooves 24 and 25 so that the collar 30 can be mounted onto the socket 21. The spring 40 is compressed between the ring 50 and the second shoulder formed on the internal face of the collar 30 so as to bias the collar 30 from the socket 21. However, the first shoulder formed on the internal face of the collar 30 is engaged with the ring 60, thus retaining the collar 30 on the socket 2. To insert a tool bit 80 defining at least one recess 81 into the socket 21, the collar 30 is moved on the socket 21 toward the shank 22 so as to align the groove 31 with the latch 70. The tool bit 80 can be inserted into the socket 21. When moved past the latch 70, an end of the tool bit 80 pushes the latch 70 into the deepest portion of the groove 31. Thus, the tool bit 80 can be inserted further into the socket 21. When the collar 30 released, the spring 40 moves the collar 30 on the socket 21 away from the shank 22 so as to disengage the groove 31 from the latch 70. Thus, the collar 30 pushes the latch 70 into the at least one recess 81 so as to lock the tool bit 80. However, the socket 21 includes a limited length from its free end to its slot 23 so that it cannot receive various tool bits 80 with various lengths from their ends to the recesses 81.

The present invention is therefore intended to obviate or at least alleviate the problems encountered in prior art.

SUMMARY OF INVENTION

It is the primary objective of the present invention to provide a connecting device for connecting a tool with tool bits of different lengths.

According to the present invention, a connecting device for connecting a tool with tool bits of different lengths includes a shank, a socket and a position retainer. The shank includes a first end for engagement with the tool and a second end. The socket includes a first end for receiving the second end of the shank and a second end for receiving the tool bits. The position retainer is capable of selectively retaining the socket in one of various positions on the shank. Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
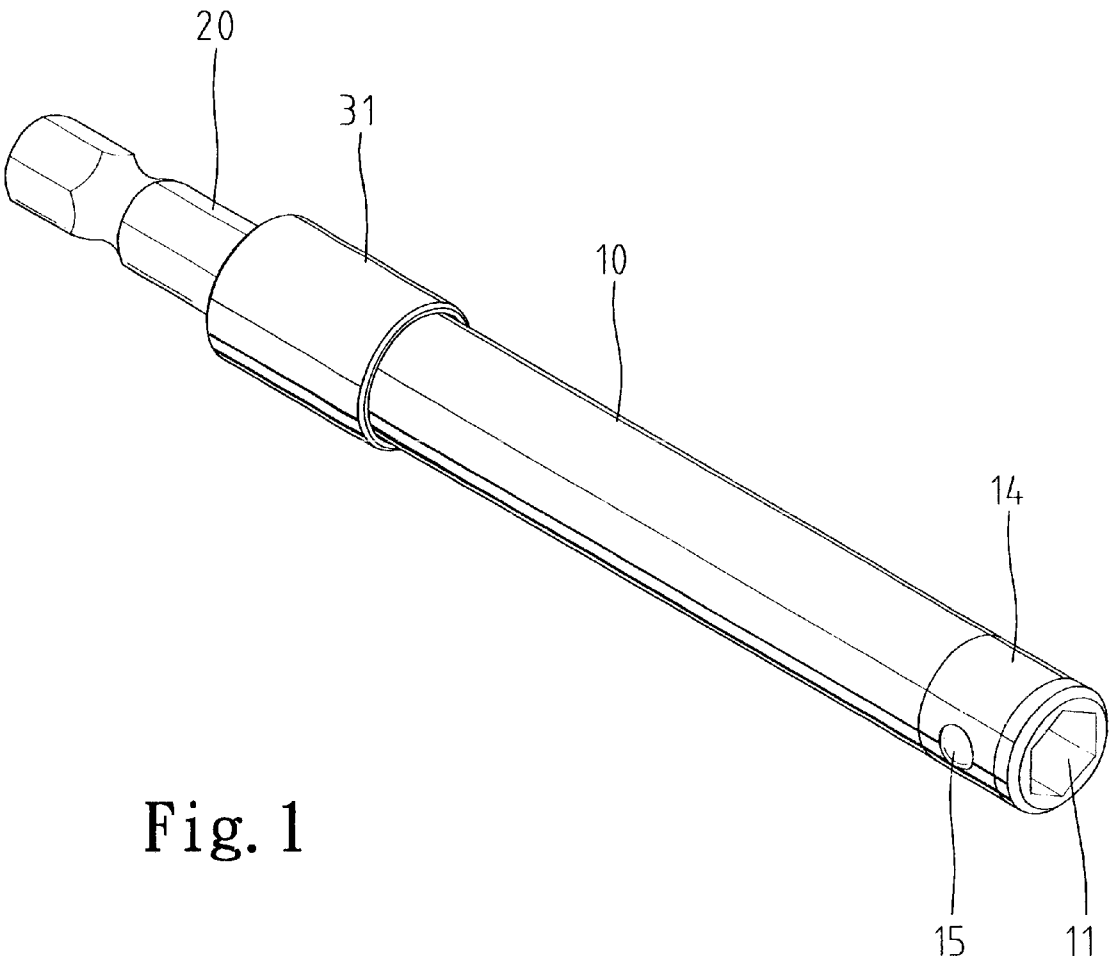
FIG. 1 is a perspective view of a connecting device according to a first embodiment of the present invention.
Figure 2:
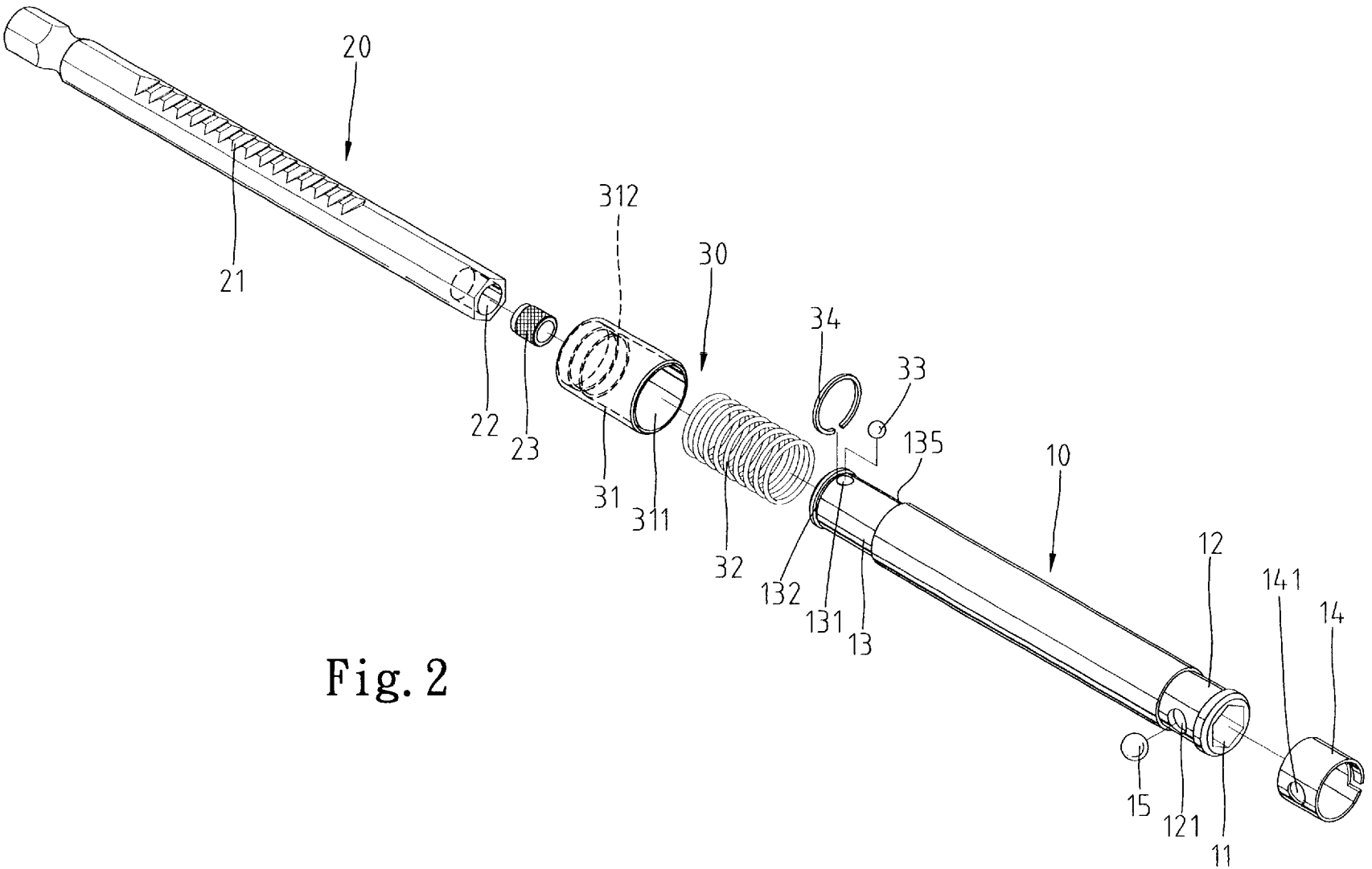
FIG. 2 is an exploded view of the connecting device.
Figure 3:
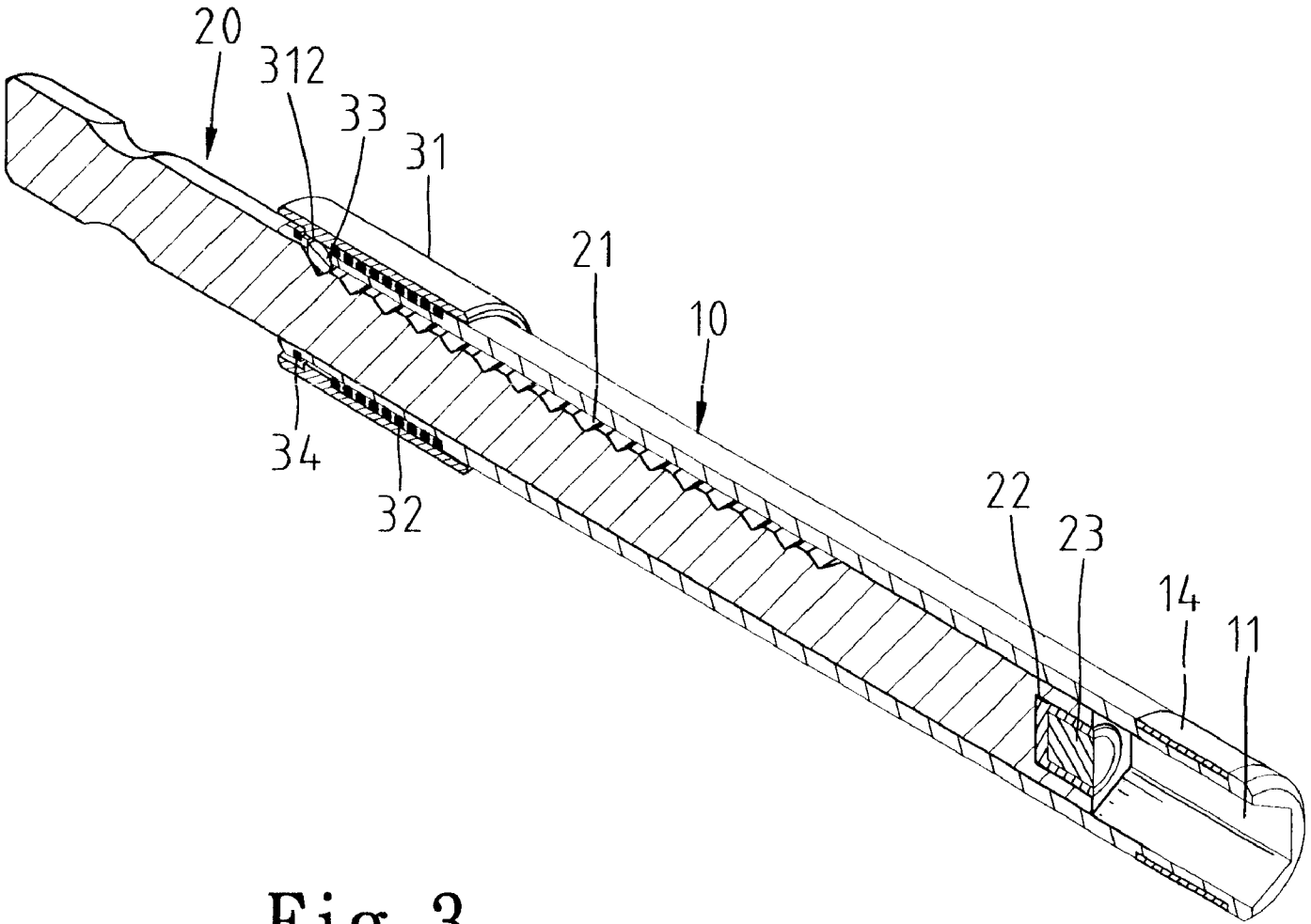
FIG. 3 is a cross-sectional view of the connecting device in a shrunk position.

Referring to FIGS. 1~3, according to a first embodiment of the present invention, a connecting device includes a shank 20 for engagement with a tool and a socket 10 for engagement with a tool bit.

The shank 20 includes a first end for engagement with the tool and a second end for insertion into the socket 10. A groove is defined in the periphery of the shank 20 near the first end. The periphery of the shank 20 defines a plurality of notches 21. A cavity 22 is defined in the second end of the shank 20. A magnet 23 is fit in the cavity 22 of the shank 20.

The socket 10 includes first and second ends and external and internal faces. The socket 10 includes a first reduced portion 13 near the first end and a second reduced portion 12 near the second end, thus forming a shoulder 135. A groove 132 is defined in the external face of the socket 10 near the first end.

A position retainer 30 is arranged between the shank 20 and the socket 10 in order to selectively retain the socket 10 in one of several positions on the shank 20. The position retainer 30 includes a first collar 31, a spring 32, a ball 33 and a C-ring 34.

The first collar 31 includes first and second ends and external and internal faces. A ridge 312 is formed on the internal face of the first collar 31 near the first end.

In assembly, the socket 10 is mounted on the shank 20 so that the aperture 131 is aligned with one of the notches 21. A ball 33 is received in the aperture 131 and the one of the notches 21. A spring 32 is mounted on the first reduced portion 13 of the socket 10. The first collar 31 is mounted on the spring 32 so that the spring 32 is compressed between the shoulder 135 and the ridge 312. A C-ring 34 is received in the groove 132. The C-ring 34 is for engagement with the ridge 321. The first collar 31 is retained on the spring 32 because the ridge 312 is restricted between the spring 32 and the C-ring 34.

A ball 15 is received in an aperture 121 defined in the second reduced portion 12 of the socket 10. A second collar 14 is mounted on the second reduced portion 12 of the socket 10. The second collar 14 defines an aperture 141 through which the ball 15 is partially exposed. Thus, the ball 15 cannot escape from the aperture 121.

Figure 6:
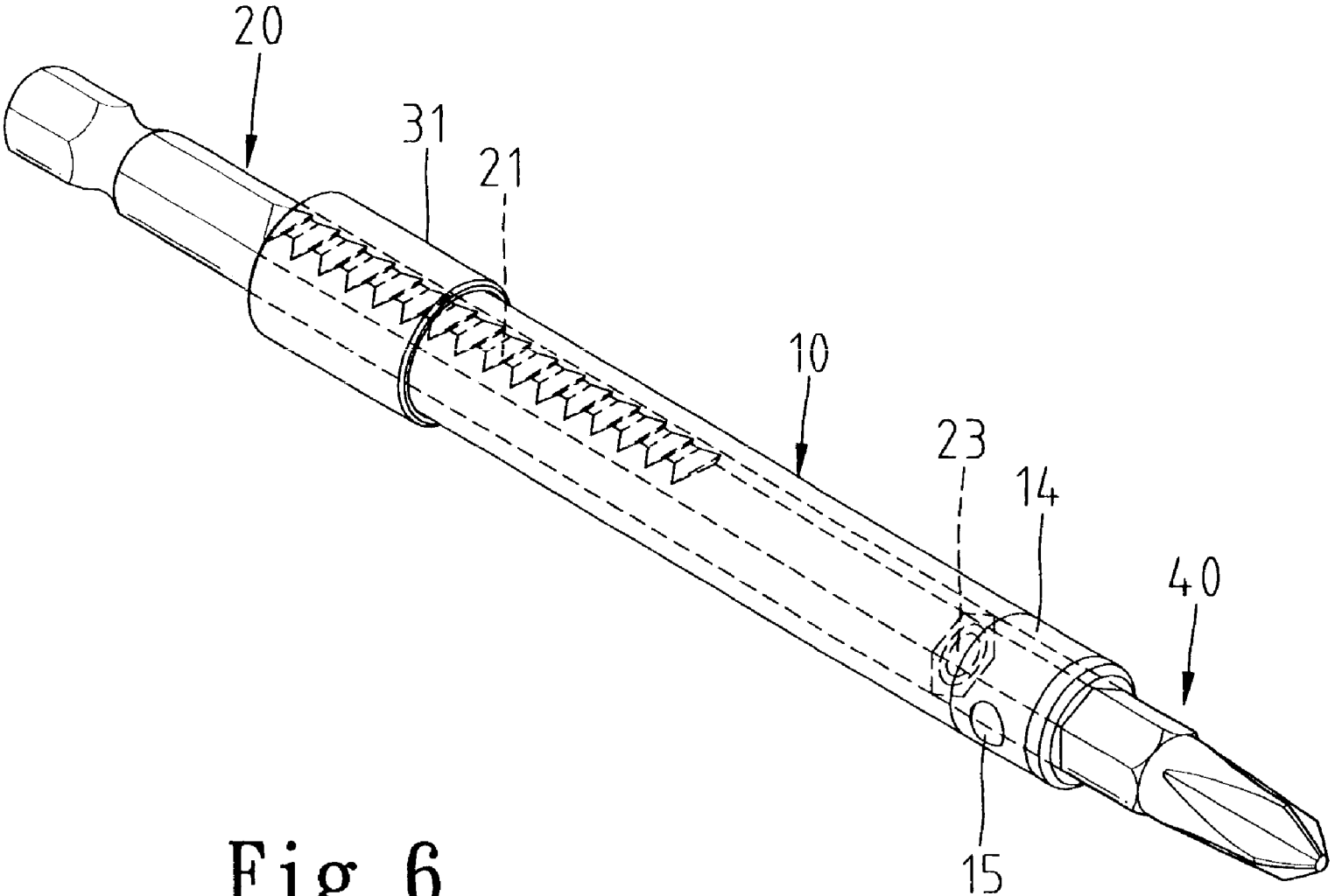
FIG. 6 is a perspective view of the connecting device in the shrunk position for receiving a short tool bit.

Referring to FIG. 3, the connecting device can be put in a shrunk position, i.e., the length of the connecting device is shortest. The ridge 312 contacts and keeps the ball 33 in the most left one of the notches 21, thus locking the connecting device in the shrunk position. As shown in FIG. 6, a short tool bit 40 is inserted into the second end of the socket 10. The ball 15 is partially received in a groove defined in the short tool bit 40, thus retaining the short tool bit 40 on the connecting device. As only a small length of the short tool bit 40 is received in the socket 10, the magnet 23 helps retain the short tool bit 40 on the connecting device.

Figure 4:
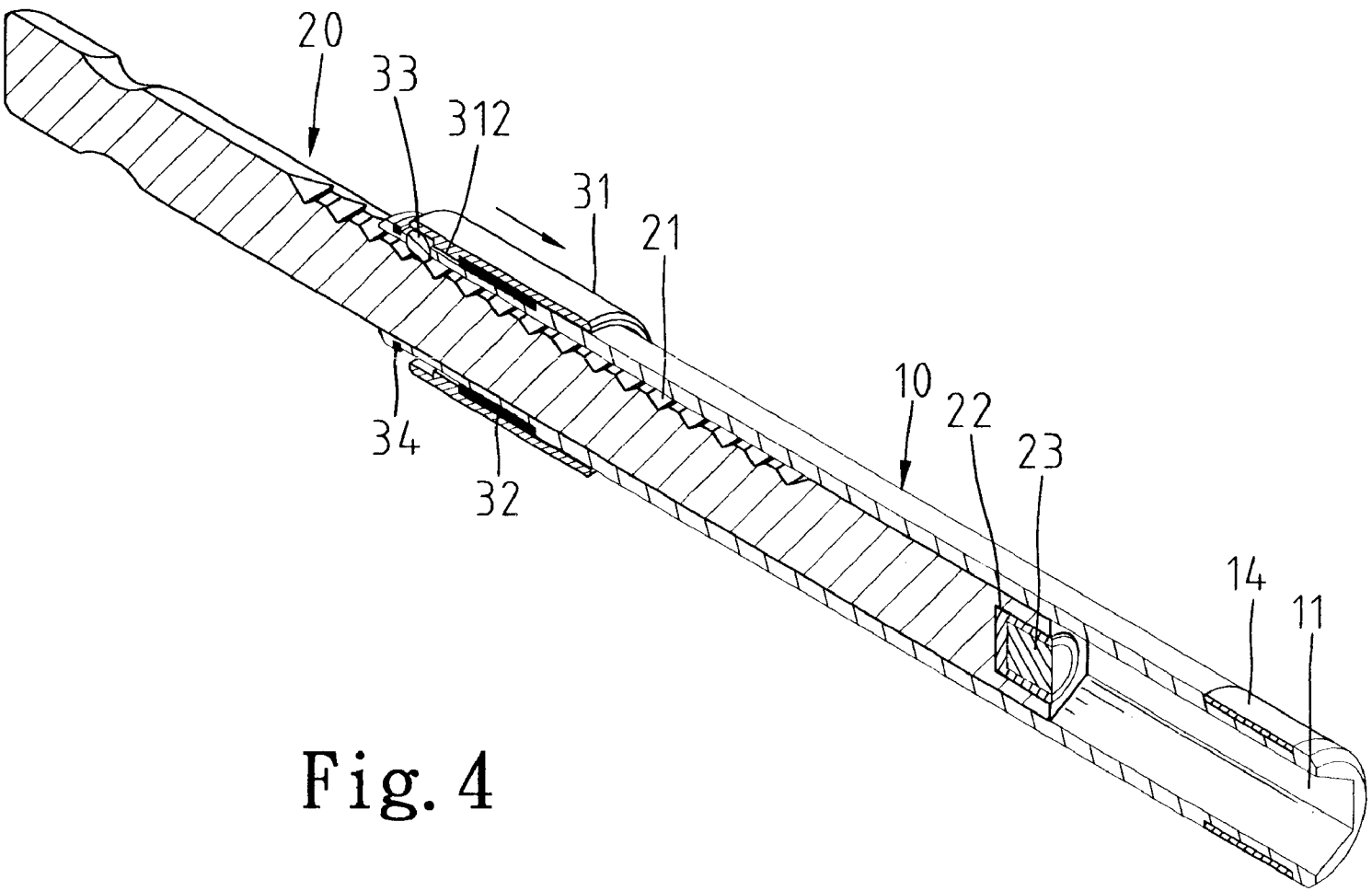
FIG. 4 is a cross-sectional view of the connecting device in another position.

Referring to FIG. 4, the first collar 31 is moved in a direction from the shank 20 towards the socket 10 so as to disengage the ball 33 from the ridge 312. Thus, the ball 33 can be disengaged from the notches 21. Therefore, the socket 10 can be moved on the shank 20.

Figure 5:
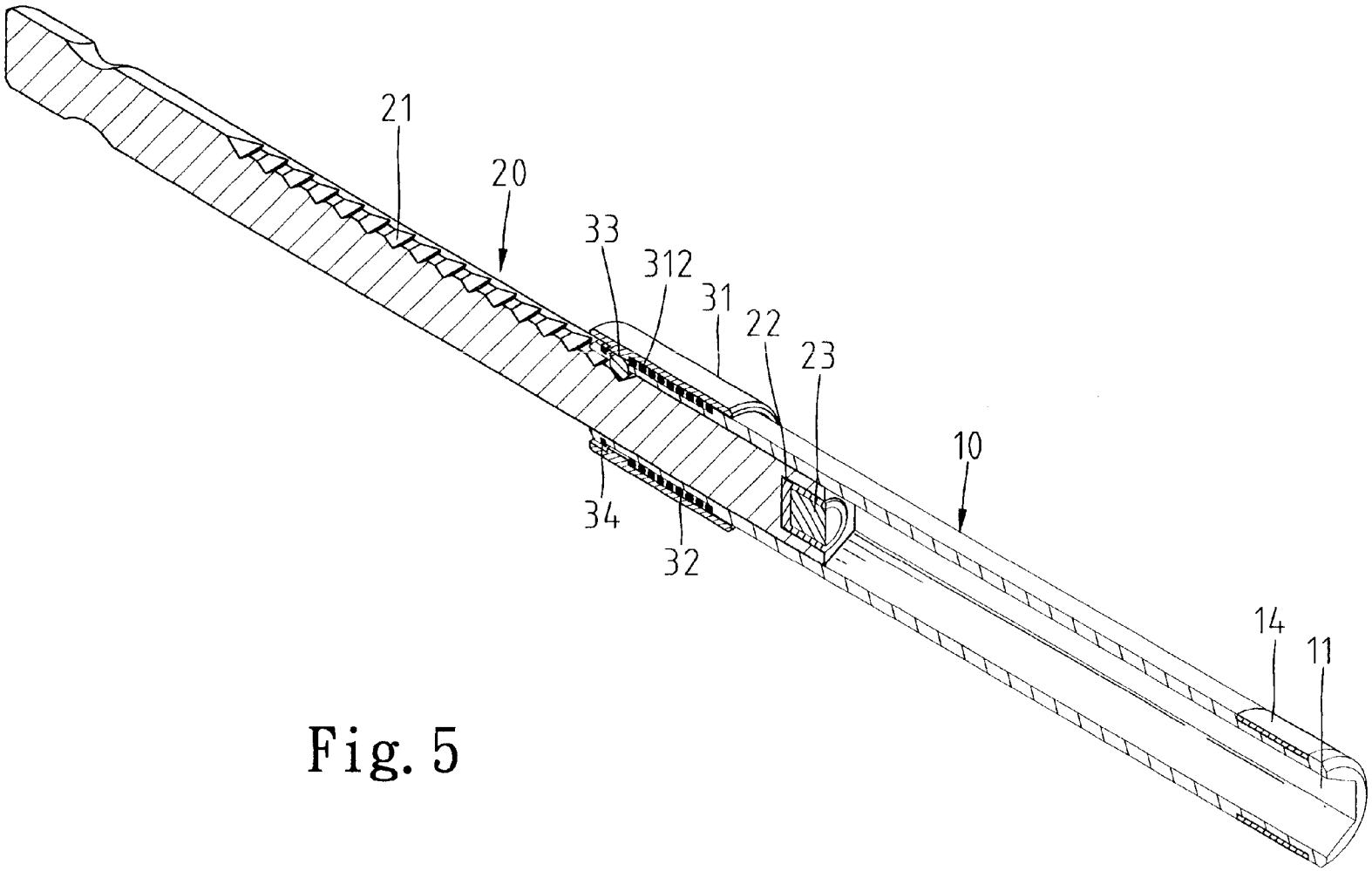
FIG. 5 is a cross-sectional view of the connecting device in an extended position.
Figure 7:
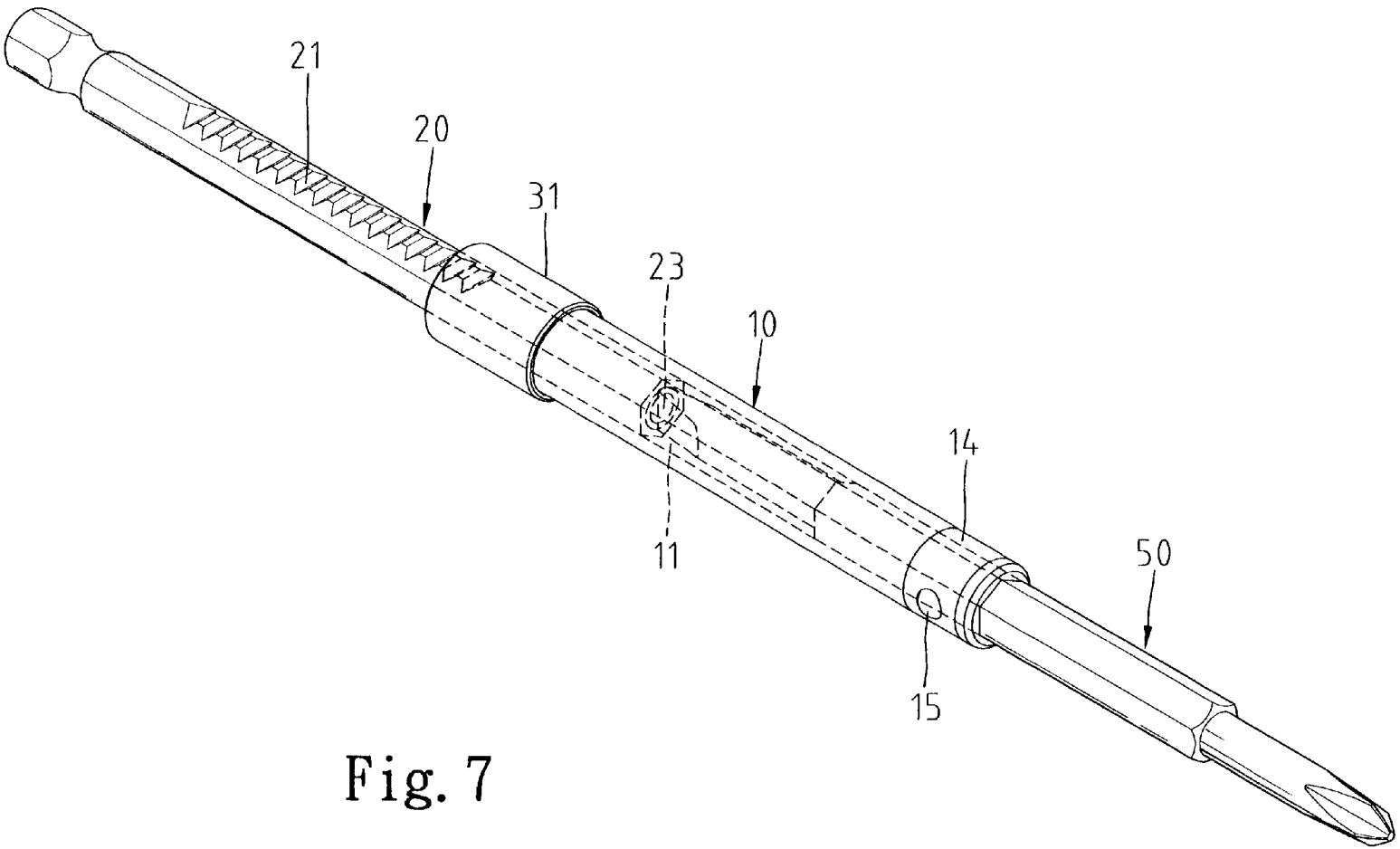
FIG. 7 is a perspective view of the connecting device in the extended position for receiving a long tool bit.

Referring to FIG. 5, the connecting device can be put in an extended position i.e., the length of the connecting device is longest. The ridge 312 contacts and keeps the ball 33 in the most right one of the notches 21, thus locking the connecting device in the extended position. As shown in FIG. 7, a long tool bit 50 is inserted into the second end of the socket 10. The ball 15 is partially received in a groove defined in the long tool bit 50, thus retaining the long tool bit 50 on the connecting device.

Figure 8:
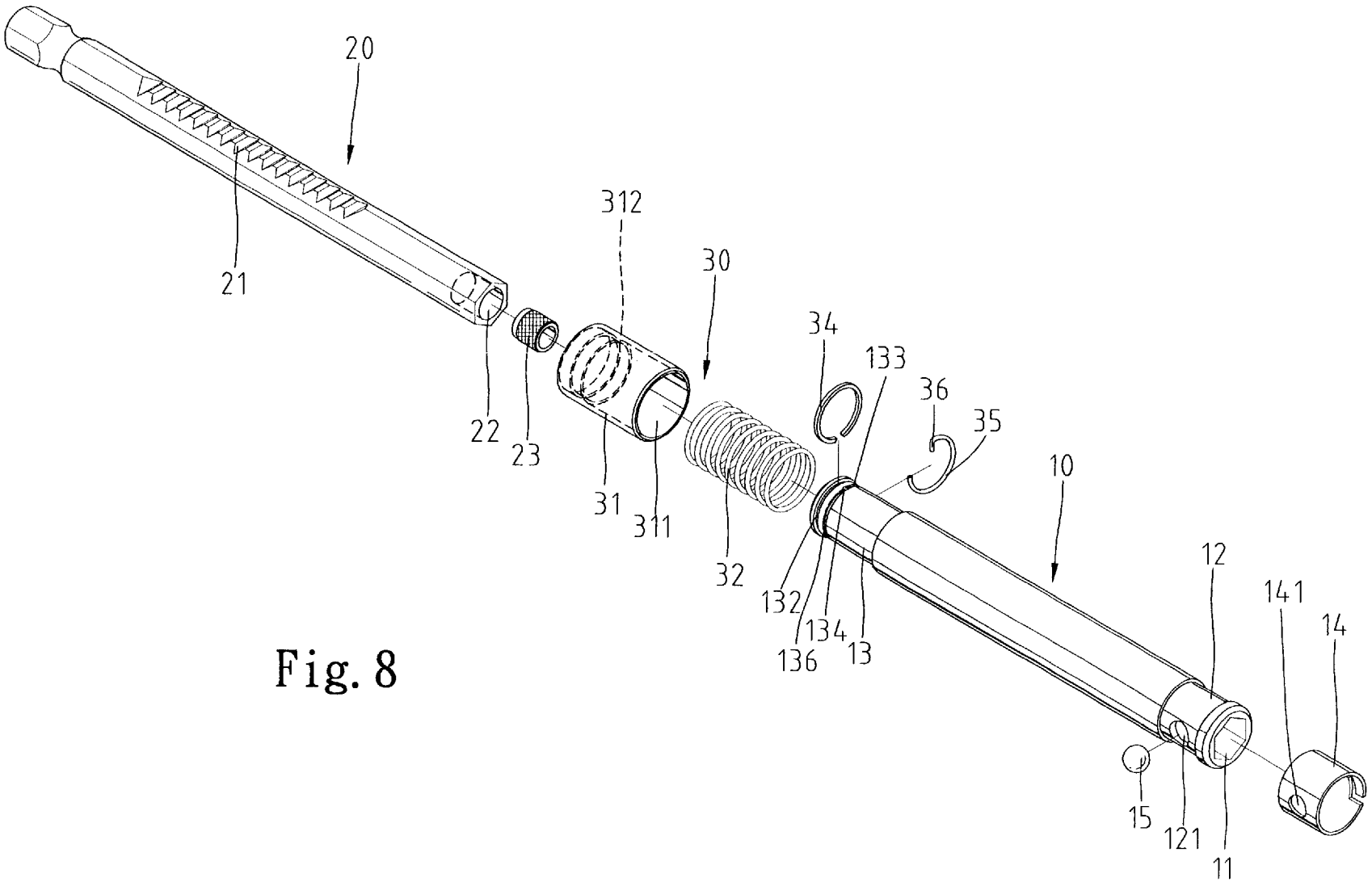
FIG. 8 is an exploded view of a connecting device according to a second embodiment of the present invention in a first position.

FIG. 8 shows a connecting device according to a second embodiment of the present invention. The second embodiment is identical to the first embodiment except that a G-ring 35 is used instead of the ball 33 and the reduced portion 13 of the socket 10 defines an aperture 134 instead of the aperture 131. The G-ring 35 includes a radial tip 36. The G-ring 35 is mounted on the reduced portion 13 of the socket 10. The radial tip 36 is inserted through the aperture 134 into one of the notches 21 in order to retain the socket 10 in position on the shank 20. A groove 136 may be defined in the external face of the socket 10 in order to receive the G-ring 35.

The present invention has been described through detailed description of the embodiments. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A connecting device for connecting a tool with tool bits of different lengths, the connecting device comprising:

a shank including a first end for engagement with the tool and a second end;

a socket including a first end for receiving the second end of the shank and a second end for receiving the tool bits; and, a position retainer for selectively retaining the socket in one of various positions on the shank, the position retainer including:

a plurality of notches defined in a periphery of the shank;

an aperture extending through the socket in a radial direction;

a latch for insertion in the notches through the aperture;

a collar with a ridge formed on an internal face, wherein the collar is mounted on the socket between a locking position where the ridge contacts and keeps the latch in one of the notches and a releasing position where the ridge leaves and allows the latch to escape from the notches.

2. The connecting device according to claim 1 including a magnet attached to the second end of the shank for attraction of the tool bits.

3. The connecting device according to claim 1 including a tool bit retainer for retaining the tool bits on the second end of the socket.

4. The connecting device according to claim 3 wherein the tool bit retainer includes an aperture extending through the socket in a radial direction and a latch received in the aperture for insertion in a recess defined in each of the tool bits.

5. The connecting device according to claim 4 wherein the tool bit retainer includes a collar mounted on the socket for retaining the latch in the aperture.

6. The connecting device according to claim 4 wherein the collar defines an aperture through which the latch is partially exposed.

7. The connecting device according to claim 1 wherein the latch is a ball.

8. The connecting device according to claim 1 wherein the latch is a pin.

9. The connecting device according to claim 8 wherein the pin is a radial tip of a G-ring mounted on the socket.

10. The connecting device according to claim 9 wherein the position retainer includes a groove defined in an external face of the socket in order to receive the G-ring.

11. The connecting device according to claim 1 wherein the position retainer includes a groove defined in the socket and a C-ring received in the groove for engagement with the ridge so as to retain the collar on the socket.

12. The connecting device according to claim 1 wherein the position retainer includes a spring mounted on the socket and compressed between a shoulder formed on the socket and the ridge in order to bias the collar to the locking position.

13. The connecting device according to claim 9 wherein the position retainer includes a groove defined in an external face of the socket in order to receive the G-ring.

* * * * *